US005652195A

United States Patent [19]

Horsten et al.

[11] Patent Number: 5,652,195

[45] Date of Patent: Jul. 29, 1997

[54] HEAT-SENSITIVE MATERIAL SUITED FOR USE IN DIRECT THERMAL IMAGING

[75] Inventors: Bartholomeus Horsten, Rumst; Guy Jansen, Borsbeek; Ronald Schuerwegen, Schelle, all of Belgium

[73] Assignee: Agfa-Gevaert N.V., Mortsel, Belgium

[21] Appl. No.: 501,827

[22] Filed: Jul. 13, 1995

[30] Foreign Application Priority Data

Jul. 13, 1994 [EP] European Pat. Off. ..... 94202023

[51] Int. Cl.[6] ..... B41M 5/40

[52] U.S. Cl. ..... 503/226; 427/152; 503/202; 503/210

[58] Field of Search ..... 427/152, 150, 427/151; 503/200, 202, 210, 217, 226; 430/338, 567, 608, 619

[56] References Cited

U.S. PATENT DOCUMENTS

| | | | |
|---|---|---|---|
| 3,031,329 | 4/1962 | Wingert | 503/210 |
| 4,421,560 | 12/1983 | Kito et al. | 106/21 |
| 4,636,819 | 1/1987 | Nagamoto et al. | 503/216 |
| 4,885,271 | 12/1989 | Kawakami et al. | 503/214 |
| 5,061,677 | 10/1991 | Yoshida et al. | 503/226 |
| 5,278,127 | 1/1994 | Dombrowski | 503/207 |

*Primary Examiner*—Bruce H. Hess

*Attorney, Agent, or Firm*—Brumbaugh, Graves, Donohue & Raymond

[57] ABSTRACT

A heat-sensitive recording material suited for use in direct thermal imaging, wherein said recording material comprises in the order given:

(i) a transparent polymeric support, (ii) a heat-sensitive imaging layer, and (iii) a protective layer characterized in that said protective layer is an opaque layer containing uniformly distributed in an organic hydrophilic polymeric binder at least one opacifying pigment in the form of particulate material some of which protrudes from the surface of said binder and has anti-stick properties with regard to a thermal print head, and wherein the opacity of layer (iii) corresponds with an absorption and/or scattering of at least 80% of the light of the visible wavelength range (400 to 700 nm), wherein said opaque layer has been coated from an aqueous dispersion of said opacifying pigment particles or precursors thereof.

18 Claims, No Drawings

HEAT-SENSITIVE MATERIAL SUITED FOR USE IN DIRECT THERMAL IMAGING

DESCRIPTION

1. Field of the Invention

The present invention relates to a heat-sensitive recording material containing a heat-sensitive imaging layer between a transparent support and an opaque layer serving as a protective layer.

2. Background of the Invention

Thermal imaging or thermography is a recording process wherein images are generated by the use of imagewise modulated thermal energy.

In "direct" thermography a visible image pattern is formed by imagewise heating of a recording material containing matter that by chemical or physical process changes colour or optical density.

In "transfer" thermography a coloured species such as a sublimation-type or meltable dye is transferred from a dye-donor element to a receptor element by signalwise applied heat (ref. e.g. U.S. Pat. No. 4,931,423.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography".

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et al., describing the production of a silver metal image by means of a thermally induced oxidation-reduction reaction of a silver soap with a reducing agent.

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–499 and 502 "direct" thermal printing proceeds with a thermal printhead receiving image signals in the form of electric pulses through a driver circuit. The thermal printhead consists of microscopic heat resistor elements, which convert the electrical energy into heat via the Joule effect. The electric pulses thus converted into thermal signals manifest themselves as heat transferred to the surface of the thermal recording material wherein a chemical reaction takes place resulting in colour development. In the thermal imaging process the printheads may attain a surface temperature of 300°–400° C., with efficient transfer of heat to the thermosensitive recording material being obtained by applying pressures of 200–500 g/cm$^2$ between said recording material and said thermal head.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs. U.S. Pat. No. 3,031,329 disclosed a heat-sensitive copy sheet including a visibly heat-sensitive layer containing, in intimate association, a normally solid organic salt of a noble metal, and a cyclic organic reducing agent for the noble metal ions, and wherein overlying surface coatings may also be added to protect the heat sensitive layer or for other purposes. Said surface coating may, for example, consist of a mixture of 3 parts of styrene-isobutylene copolymer, 30 parts of zinc oxide, and 1 part of silica gel, smoothly dispersed in and applied from heptane, the dried coating serving both to protect the heat-sensitive layer from moisture and abrasion and to serve as a contrasting white background for darkened image areas as viewed through the transparent paper support.

According to FR-P 2503729 a reversible thermochromic substance is described consisting of one or more organic chromatic electron donors and one or more phosphoric acid esters. Said reversible thermochromic substance may be provided with a protective layer which may be transparent, translucent, opaque or coloured. Printing ink, paint etc. may be thermally bonded to the surface either directly or after printing or coating. Said protective layer may possess irregularities producing a visual effect and not only provided physical protection for the thermochromic layer, but also protection against weathering.

According to U.S. Pat. No. 3,107,174 a preferred copy-sheet structure contains a silver soap, reducing agent, toners and other auxiliary components, together with terpene resin and zinc oxide, uniformly intimately dispersed within a resinous binder as a coating on a paper or paper-like carrier. A protective surface coating may be applied over the color-forming coating; where the protective coating is opaque, a transparent film or paper is employed as the carrier member. The terpene resins are useful in decreasing the fingerprinting tendency of the silver soap sheet materials and are advantageously applied in combination with polyvinyl acetate and cellulose acetate being applied from an acetone solvent medium.

As described in U.S. Pat. No. 5,275,932 a protective layer having anti-stick properties is preferably coated on top of a thermal imaging layer for direct thermal recording with thermal printhead. Said anti-stick layer prevents sticking of the thermographic construction of thermal printheads to the recording material in the recording stage, and avoids the production of scratches that may cause artifacts in the image.

Useful protective anti-stick layers may contain in a polymeric binder medium waxes and silica particles but such in a degree that the layer is transparent and the image-information inspectable therethrough. The polymeric binding agents of the usual anti-stick layers are synthetic or semi-synthetic polymers as exemplified e.g. in said U.S. Pat. No. 5,275,932, col. 5, lines 24–30, which polymers require coating from organic solvent medium.

Heat-sensitive recording materials with opaque protective layers applied from organic solvent dispersions exhibit poor transport properties under the thermal heads and cause build-up on thermal heads resulting in image degradation due to poor thermal contact and cause surface scratching of the heat-sensitive recording materials. Furthermore opaque protective layers coated from organic solvents exhibit cloudiness and non-uniform distribution of the opacifying pigment particles due to patterns in the protective layer induced by the drying process (see comparative example 2 of the present text) such as described in the booklet: "Coating Film Defects", published in January 1988 by the Federation of Societies for Coating Technology, 1315 Walnut St., Philadelphia, Pa. 19107, USA.

Such non-uniformity in the distribution of opacifying pigment particles in the opaque protective layer after thermal processing with a thermal head negates the possibility with heat-sensitive recording materials with opaque protective layers, of inspecting the image obtained through the transparent support without detecting image artifacts due to fingerprints on the outermost surface of the protective layer or those resulting from frictional contact of said outermost surface with the printing head.

In addition the image resolution of the heat-sensitive layer viewed through the transparent polymeric support is adversely affected by light scattering at the interface between an opaque protective layer coated from an organic solvent and the heat sensitive layer, due to diffusion of the opacifying pigment particles into the heat-sensitive layer.

Furthermore coating from organic solvent media has negative economic and ecological consequences, resulting in the need for investment in organic solvent recovery units, the dangers of atmospheric pollution should the organic solvent not be completely recovered and and the need for investment in organic solvent explosion prevention measures.

OBJECTS AND SUMMARY OF THE INVENTION

It is an object of the present invention to provide a solution to the above problems.

It is more particularly an object of the present invention to provide a heat-sensitive recording material with transparent support which material is suited for use in direct thermal imaging with a thermal printhead, and wherein said material has an opaque outermost layer, with a uniform distribution of opacifying pigment particles, on the imaging layer without preventing heat reaching the imaging layer, the transparent support allowing inspection of the image obtained in the imaging layer without detection of possible image artifacts due to fingerprints on, or frictional contact of the thermal printhead with, the outermost surface of said opaque layer.

It is a further object of the present invention to provide an opaque outermost layer, which is coatable from aqueous dispersions.

It is a further object of the present invention to provide a heat-sensitive recording material with transparent support having good anti-stick properties for use in direct thermal imaging.

Other objects and advantages of the present invention will appear from the further description.

According to the present invention a heat-sensitive recording material suited for use in direct thermal imaging is provided, said recording material comprising in the order given:

(i) a transparent polymeric support, (ii) a heat-sensitive imaging layer, and (iii) a protective layer characterized in that said protective layer is an opaque layer containing uniformly distributed in an organic hydrophilic polymeric binder at least one opacifying pigment in the form of particulate material some of which protrudes from the surface of said binder and has anti-stick properties with regard to a thermal printhead, wherein the opacity of layer (iii) corresponds with an absorption and/or scattering of at least 80% of the light of the visible wavelength range (400 to 700 nm).

Optionally an intermediate layer acting as subbing layer (adhesion-promoting layer) is present between layers (ii) and (iii). A suitable subbing layer is described in titled: "Multilayer Thermal Recording Material" filed by the same applicant on even date herewith.

Layer (iii) may be provided with an outermost anti-sticking layer, also called slipping layer, examples of which are described in published European patent applications (EP-A) 501 072, 492 411 and 311 841 and in U.S. Pat. Nos. 4,567,113, 4,572,860 and 4,717,711.

A process for the production of said heat-sensitive recording material suited for use in direct thermal imaging is also provided, said recording material comprising in the order given:

(i) a transparent polymeric support, (ii) a heat-sensitive imaging layer, and (iii) a protective layer characterized in that said protective layer is an opaque layer containing uniformly distributed in an organic hydrophilic polymeric binder at least one opacifying pigment in the form of particulate material some of which protrudes from the surface of said binder and has anti-stick properties with regard to a thermal printhead, wherein the opacity of layer (iii) corresponds with an absorption and/or scattering of at least 80% of the light of the visible wavelength range (400 to 700 nm), characterized in that said opaque layer has been coated from an aqueous dispersion of said opacifying pigment particles or precursors thereof.

"Opaque" does not mean white since the anti-stick layer may form a coloured, e.g. yellow, image-background.

After the thermal recording the obtained image can be inspected through the transparent support; any fingerprints or scratches formed on the opaque covering layer are masked by its opacity and are not visible as image artifacts.

In the heat-sensitive imaging layer an image is formed by thermally induced chemical reaction between reagents that are in thermal working relationship. The imaging layer contains at least the reagent providing the imaging substance, the other reagent(s) may be present in an adjacent layer wherefrom they diffuse on heating into the imaging layer.

DETAILED DESCRIPTION OF THE INVENTION

The organic hydrophilic water-soluble colloid binder of the opaque layer of the heat-sensitive recording material according to the present invention is preferably a protein-type binding agent such as gelatin, casein, collagen, albumin, or gelatin derivative, e.g. acetylated gelatin. Further suitable water-soluble hydrophilic polymeric binding agents are: polyvinyl alcohol, dextran, gum arabic, zein, agar-agar, arrowroot, pectin, carboxymethyl cellulose, ethyl cellulose, poly(acrylamide) and polyvinyl pyrrolidone. The organic hydrophilic polymeric binder of the opaque anti-stick layer may be hardened to some extent.

For improving the mechanical strength of protective anti-stick layers on the basis of a proteinaceous colloid binder, preferably gelatin, hardening agents, e.g. polyepoxy compounds, known therefor from gelatin-silver halide photographic materials may be used.

Mechanical strength of gelatinous anti-stick layers may likewise be improved by a reaction in which inorganic silica particles dispersed in the binder medium are bound to gelatin by organic silicon compounds as described e.g. in U.S. Pat. No. 3,661,584.

The substances providing opacity and having anti-stick properties with regard to thermal printheads are selected from inorganic or organic pigments and may be matting agents known from photographic silver halide materials.

Organic matting agents suited for .use as opacifying materials according to the present invention are described e.g. in U.S. Pat. Nos. 4,396,706, 4,447,525, 4,820,615 and in U.S. Pat. No. 4,235,959 wherein a matting agent comprising silica and urea-formaldehyde resin is described.

The degree of opacity is determined by the "hiding power" of the pigments or matting agents by which is meant that a certain coverage ($g/m^2$) of pigment or matting agent gives a more or less effective shielding against visible light by reflection and/or absorption.

As inorganic matting agents are mentioned: zinc sulphide and lithopone ($ZnS+BaSO_4$) which were widely used as white opacifying material until titanium dioxide pigments (anatase or rutile) were put on the market [ref. "Organic Coating Technology"—Vol. II Pigments and Pigmented Coatings by Henry Fleming Payne, John Wiley & Sons, Inc. New York—London (1961), p.765]. Therefore, preference is given nowadays for high opacity in thin layers to binder layers containing titanium dioxide or such pigment coated with e.g. hydrated aluminium oxide and/or silicon dioxide prepared as described e.g. in U.S. Pat. No. 3,928,037.

The use of a heat-sensitive recording material having a relatively thin outermost opaque layer layouts good heat-conduction and image sharpness.

The thickness of the opaque layer should preferably be in the range of 5 to 30 μm, and the pigment to binder weight ratio should preferably be relatively high. For example, the pigment to binder weight ratio should preferably be in the range of 1/2 to 25/1.

Preferably the whole surface of the opaque layer is densely populated with protruding anti-fricton (anti-stick) particles.

The surface roughness of the anti-stick layer surface may be determined with a PERTHOMETER (tradename of Mahr-Perthen, Germany). It is expressed by the sum of two terms, namely W+Rt, wherein W (Welligkeit) is the depth measure for the macro-unevennesses of the surface and Rt is the depth measure of the micro-unevennesses of the surface. "Macro-unevenness" here refers to the deviation of the general surface contour from a plane and "micro-unevenness" refers to the surface irregularities which are present locally in successive parts of the surface contour.

Preferably the relief configuration of the surface of said anti-stick layer is characterized by a "micro-unevenness" of at least 3 μm; preferably in the range of 5 to 10 μm.

The average grain size of the opacifying material is preferably at least 0.25 μm and at most 20 μm.

Titanium dioxide particles and silica particles having an average grain size of 0.25 to 5 μm are particularly suited for opacifying and anti-sticking purposes.

Commercially available silica's particularly suited for use according to the present invention are e.g. SYLOID 378 and SYLOID 72 (SYLOID is a tradename of GRACE Company, USA) (average grain size 4.5 μm).

In order to reduce friction with a thermal head during direct thermal recording the anti-stick layer may contain additionally a liquid or solid lubricant in an amount of 0.1 to 10% by weight with respect to the hydrophilic colloid binder.

The protective anti-stick layer applied according to the present invention may contain additives provided such materials do not inhibit its anti-sticking properties and provided that such materials do not scratch, erode, contaminate, or otherwise damage the thermal printing head or harm image quality.

Additives having a cleaning effect on the thermal printhead are inorganic silicate particles.

Preferred matting inorganic particles having a mildly abrasive character are i.e. clay, China clay (kaolin), mica, calcium silicate, aluminium silicate, talc (magnesium silicate), and aluminium magnesium silicate. These particles are incorporated in the anti-stick layer preferably in such a way that at least part of them protrudes.

The presence of these particles protruding from the surface of the opaque layer has a cleaning effect on the thermal printing head in that while slipping along the head they remove any foreign substances adhering to the thermal printing head e.g. dust, binder, and releasing agent, and take them away by retaining them in the interstitial spaces between the protruding particles. In this way contamination of the thermal printing head by any such foreign substances is avoided.

The inorganic silicate particles for use in the present opaque anti-stick layer preferably have an average particle size ranging from 1 to 8 μm and less than 10% by volume of said particles has a size higher than 10 μm.

The particle size of inorganic silicate particles suited for use in the anti-stick layer of the recording material according to the present invention may be determined with a Coulter Multisizer II (tradename) having an aperture of 30 μm, enabling particle size determination in the range 0.7 to 22.4 μm. A particle having a size of 5 μm (Dynosphere SS-051-P) is used to calibrate the apparatus. The calibration constant is 349.09. The silicate particles are dispersed in an aqueous 0.1N sodium chloride solution containing a fluorine surfactant before the measurement of the particle size and of the particle size distribution. The selected siphon mode is 500 μl.

It has been established that talc provides a very good cleaning and lubricating effect. Talc has a Mohs' hardness of 1.0 so that it does not abrade the passivation layer of the thermal printhead.

Examples of talc particles that can be used advantageously in accordance with the present invention are i.a.:

- Talc 1: Micro Ace Type P3 having a volume average particle size of 4.5 μm and 1.29% by volume thereof having a size higher than 10 μm (commercially available from Nippon Talc, Interorgana Chemiehandel);
- Talc 2: Mistton Ultramix having a volume average particle size of 3.88 μm and 1.72% by volume thereof having a size higher than 10 μm (commercially available from Cyprus Minerals);
- Talc 3: Micro-talc I.T. Extra having a volume average particle size of 4.33 μm and 2.43% by volume thereof having a size higher than 10 μm (commercially available from Norwegian Talc Minerals);
- Talc 4: Cyprubond (surface-treated to improve adhesion to the binder) having a volume particle size of 5.28 μm and 9.22% by volume thereof having a size higher than 10 μm (commercially available from Cyprus Minerals);
- Talc 5: MP10–52 having a volume particle size of 3.15 μm and 1.26% by volume thereof having a size higher than 10 μm (commercially available from Pfizer Minerals);
- Talc 6: MP12–50 having a volume particle size of 2.60 μm and 0.97% by volume thereof having a size higher than 10 μm (commercially available from Pfizer Minerals);
- Talc 7: Micro-talc A.T. Extra having a volume average particle size of 4.32 μm and 3.76% by volume thereof having a size higher than 10 μm (commercially available from Norwegian Talc Minerals);
- Talc 8: Stellar 600 having a volume average particle size of 5.16 μm and 6.77% by volume thereof having a size higher than 10 μm (commercially available from Norwegian Cyprus Minerals).

Examples of other commercially available silicate particles that can be used in accordance with the present invention are i.a.:

IRIODIN 111 (IRIODIN is a tradename of Merck) which are mica particles having an average particle size of 4.42 μm and 1.45% by volume thereof having a size higher than 10 μm; and CHLORITE (commercially available from Cyprus Minerals) being a magnesium-aluminium silicate having an average particle size of 5.57 μm and 16.58% by volume thereof having a size higher than 10 μm.

The opaque anti-stick layer of a direct thermal recording material according to the present invention may in addition to the opacifying or matting anti-stick material comprise minor amounts of such other agents like liquid or solid lubricants or mixtures thereof.

Examples of suitable lubricating materials are surface active agents. The surface active agents may be carboxylates, sulfonates, phosphates, aliphatic amine salts, aliphatic quaternary ammonium salts, polyoxysthylene alkyl ethers, polyethylene glycol fatty acid esters or fluoroalkyl $C_2$–$C_{20}$ aliphatic acids.

Examples of liquid lubricants include silicone oils, e.g. BAYSILONE Ö1 (tradename of BAYER AG, Germany), synthetic oils, saturated hydrocarbons and glycols. Examples of solid lubricants are various higher alcohols such as stearyl alcohol, fatty acids and fatty acid esters.

Organic solid lubricants in the form of polysiloxane-polyether copolymers and polytetrafluoroethylene particles are useful anti-friction agents as described e.g. in U.S. Pat. No. 4,059,768.

Adhesion between the opaque layer of the heat-sensitive recording material according to the present invention and its heat-sensitive imaging layer can be improved by treating the surface of said heat-sensitive imaging layer with ions from a corona discharge prior to coating said opaque layer.

The heat-sensitive imaging layer of the thermographic recording material according to the present invention preferably contains in a water-insoluble organic polymeric binder a substantially light-insensitive organic heavy metal salt in thermal working relationship with an organic reducing agent.

The binder may be a natural, modified natural or synthetic water-insoluble resin, e.g. a cellulose derivative such as ethylcellulose, cellulose ester, e.g. cellulose nitrate, a polymer derived from α,β-ethylenically unsaturated compounds such as polyvinyl chloride, after-chlorinated polyvinyl chloride, a copolymer of vinyl chloride and vinylidene chloride, a copolymer of vinyl chloride and vinyl acetate, polyvinyl acetate and partially hydrolyzed polyvinyl acetate, a polyvinyl acetal that is made from polyvinyl alcohol as starting material in which only a part of the repeating vinyl alcohol units may have reacted with an aldehyde, preferably polyvinyl butyral, a copolymer of acrylonitrile and acrylamide, a polyacrylic acid ester, a polymethacrylic acid ester and polyethylene or mixtures thereof.

A particularly suitable binder for organic silver soaps is polyvinyl butyral containing a minor amount of vinyl alcohol units and is marketed under the trade name BUTVAR B79 of Monsanto USA.

The above mentioned polymeric binders of the heat-sensitive layer may be used in conjunction with waxes or "heat solvents" also called "thermal solvents" or "thermo-solvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic silver salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1,1-dioxide, methyl anisate and 1,10-decanediol being described as heat solvents in Research Disclosure, December 1976, (item 15027) pages 26–28. Still further examples of heat solvents have been described in U.S. Pat. Nos. 3,438,778, and 4,740,446, and in published EP-A 0 119 615 and 0 122 512 and DE-A 3 339 810.

Suitable reducible organic heavy metal salts are the iron salts of organic acids yielding iron on thermally induced reduction, e.g. the iron salts described in EP-A 0 520 404, more particularly iron o-benzoylbenzoate, or substantially light-insensitive organic silver salts yielding silver metal upon thermally induced reduction.

Substantially light-insensitive organic silver salts particularly suited for use in direct thermal recording materials are silver salts of aliphatic carboxylic acids known as fatty acids, wherein the aliphatic carbon chain has preferably at least 12 C-atoms, e.g. silver laurate, silver palmirate, silver stearate, silver hydroxystearate, silver oleate and silver behenate. Modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677. A particularly suitable organic silver salt for the heat-sensitive recording materials of the present invention is silver behenate.

The reducing agent(s) stand in thermal working relationship with the substantially light-insensitive organic heavy metal salt(s) by which is meant that they may be present in the same or an adjacent layer but are capable to come on heating into reactive contact with the silver salt(s).

Suitable organic reducing agents for the reduction of organic heavy metal salts, preferably substantially light-insensitive organic silver salts, are organic compounds containing at least one active hydrogen atom linked to O, N or C, such as is the case in aromatic poly-hydroxy compounds, e.g. polyhydroxy-benzene compounds such as hydroquinone and substituted hydroquinones, catechol, pyrogallol, gallic acid and gallic acid esters, polyhydroxy-spiro-bis-indane compounds, aminophenols, METOL (tradename), p-phenylenediamines, alkoxynaphthols, e.g. 4-methoxy-1-naphthol described in U.S. Pat. No. 3,094,417, pyrazolidin-3-one type reducing agents, e.g. PHENIDONE (tradename), pyrazolin-5-ones, indanedione-1,3 derivatives, hydroxytetrone acids, hydroxytetronimides, hydroxylamine derivatives (ref. e.g. U.S. Pat. No. 4,082,901), hydrazinc derivatives, reductones, and ascorbic acid; see also U.S. Pat. No. 3,074,809, 3,080,254, 3,094,417, 3,887,378 and unpublished EP-A No, 93203120.6.

The layer containing the organic silver salt is commonly coated from an organic solvent containing the binder in dissolved form.

The binder to organic silver salt weight ratio is preferably in the range of 0.2 to 6, and the thickness of the recording layer is preferably in the range of 5 to 20 μm.

The silver image density depends on the coverage of the applied reducing agent(s) and organic silver salt(s) and is preferably such that on heating above 100° C. an optical density of at least 1.5 can be obtained. Preferably at least 0.10 mole of reducing agent per mole of organic silver salt is used.

In order to obtain a neutral black image tone in the higher densities and neutral grey in the lower densities the recording layer contains in admixture with said organic silver salt and reducing agents a so-called toning agent known from thermography or photo-thermography.

Suitable toning agents are the phthalimides and phthalazinones within the scope of the general formulae described in U.S. Pat. No. 4,082,901. Further reference is made to the toning agents described in U.S. Pat. No. 3,074,809, 3,446,648 and 3,844,797. Other particularly useful toning agents are the heterocyclic toner compounds of the benzoxazine dione or naphthoxazine dione type within the scope of following general formula:

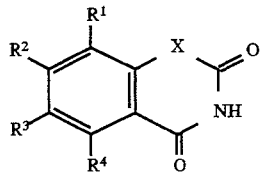

in which:

X represents O or N-alkyl;

each of $R^1$, $R^2$, $R^3$ and $R^4$ (same or different) represents hydrogen, alkyl, e.g. C1–C20 alkyl, preferably C1–C4 alkyl, cycloalkyl, e.g. cyclopentyl or cyclohexyl, alkoxy, preferably methoxy or ethoxy, alkylthio with preferably up to 2 carbon atoms, hydroxy, dialkylamino of which the alkyl groups have preferably up to 2 carbon atoms or halogen, preferably chlorine or bromine; or $R^1$ and $R^2$ or $R^2$ and $R^3$ represent the ring members required to complete a fused aromatic ring, preferably a benzene ring, or $R^3$ and $R^4$ represent the ring members required to complete a fused aromatic or cyclohexane ring. Toners within the scope of said general formula are described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

In addition to said ingredients the recording layer may contain other additives such as free fatty acids, antistatic agents, e.g. non-ionic antistatic agents including a fluorocarbon group as e.g. in $F_3C(CF_2)_6CONH(CH_2CH_2O)$-H, ultraviolet light absorbing compounds, white light reflecting and/or ultraviolet radiation reflecting pigments, silica, and/or optical brightening agents.

The support for the heat-sensitive recording material according to the present invention is preferably a thin flexible transparent carrier made e.g. from a cellulose ester, e.g. cellulose triacetate, polypropylene, polycarbonate or polyester, e.g. polyethylene terephthalate. The support may be in sheet, ribbon or web form and subbed if need be to improve the adherence to the thereon coated heat-sensitive recording layer. The transparent base may be colourless or coloured, e.g. has a blue colour.

The coating of the heat-sensitive layer and of the opaque anti-stick layer may proceed by any coating technique e.g. as described in Modern Coating and Drying Technology, edited by Edward D. Cohen and Edgar B. Gutoff, (1992) VCH Publishers Inc., 220 East 23rd Street, Suite 909 New York, N.Y. 10010, U.S.A.

The direct thermal recording materials of the present invention are particularly suited for use in thermographic recording techniques operating with thermal print-heads. Suitable thermal printing heads are e.g. a Fujitsu Thermal Head (FTP-040 MCS001), a TDK Thermal Head F415 HH7-1089, and a Rohm Thermal Head KE 2008-F3.

In another embodiment of "direct" thermal imaging the recording material is image-wise or pattern-wise heated by means of a modulated laser beam, wherein image-wise modulated laser light is directed through the transparent support and heats the imaging layer internally by absorption of the laser light and conversion into the heat necessary for the imaging reaction.

When using infrared laser light the imaging layer contains preferably infra-red light absorbing substances thereby converting absorbed radiation into the heat necessary for the imaging reaction. Examples of such substances are given in U.S. Pat. No. 4,912,083, 5,219,703 and 5,256,620, and in published EP-A 582 144.

The imagewise applied laser light need not necessarily be infrared light since the power of a laser in the visible light range and even in the ultraviolet region may be sufficiently high to enable enough heat to be generated upon absorption of the laser light in the recording material. There is no limitation on the kind of laser used which may be a gas laser, gas ion laser, e.g. argon ion laser, solid state laser, e.g. Nd:YAG laser, dye laser or semi-conductor laser. Suitable infra-red light absorbing dyes are known from dye donor elements used for laser-induced thermal dye transfer as described e.g. in U.S. Pat. Nos. 4,948,777 and 5,275,925.

The following examples illustrate the present invention without however limiting it thereto. The percentages and ratios are by weight unless otherwise indicated.

COMPARATIVE EXAMPLE 1

Heat-sensitive recording material A1 (non-invention material)

A transparent subbed polyethylene terephthalate support having a thickness of 100 μm was doctor blade-coated from a coating composition containing 2-butanone as a solvent and the following ingredients so as to obtain thereon after drying a layer containing:

| | |
|---|---|
| silver behenate | 4.42 g/m² |
| polyvinyl butyral (BUTVAR B79-tradename) | 4.42 g/m² |
| 3,4-dihydro-2,4-dioxo-1,3,2H-benzoxazine | 0.34 g/m² |
| 1,1'-spirobi(1H-indene)-5,5',6,6'-tetrol-2,2',3,3'-tetrahydro-3,3,3',3'-tetramethyl | 0.84 g/m² |
| BAYSILONE Ö1 (tradename) | 0.017 g/m² |

INVENTION EXAMPLE 1

Heat-sensitive recording material B1 (invention material)

A transparent subbed polyethylene terephthalate support having a thickness of 100 μm was doctor blade-coated from a coating composition containing 2-butanone as a solvent and the following ingredients so as to obtain thereon after drying a first layer containing:

| | |
|---|---|
| silver behenate | 4.42 g/m² |
| polyvinyl butyral (BUTVAR B79-tradename) | 4.42 g/m² |
| 3,4-dihydro-2,4-dioxo-1,3,2H-benzoxazine | 0.34 g/m² |
| 1,1'-spirobi(1H-indene)-5,5',6,6'-tetrol-2,2',3,3'-tetrahydro-3,3,3',3'-tetramethyl | 0.84 g/m² |
| BAYSILONE Ö1 (tradename) | 0.017 g/m² |

Onto said dried first layer a second layer was coated from aqueous medium so as to obtain thereon after drying an opaque hydrophilic binder layer serving as protective anti-stick layer having a thickness of 23.5 μm and containing:

| | |
|---|---|
| anatase type titanium dioxide | 20.87 g/m$^2$ |
| gelatin | 2.50 g/m$^2$ |

Thermographic printing 10 cm×10 cm sheets of heat-sensitive recording materials A1 and B1 were processed uniformly with a thermal head printer MITSUBISHI CP100 (tradename) having the printhead in direct contact with the imaging layer of heat-sensitive recording material A1 and in direct contact with the anti-stick layer of heat-sensitive recording material B1.

The solid area print obtained in "non-invention" material A1 showed streaks of reduced density and the printhead was smudged.

The solid area print obtained in "invention" material B1 was uniformly black against a white opaque background and no smudging of the printhead took place. The adhesion of the opaque layer to the underlying imaging layer was all right, no stripping or rippling took place.

Before thermal printing the "transmission" optical density of the above mentioned opaque layer was measured after directly coating and drying said layer onto the above mentioned transparent support. In the measurement a Macbeth TD 504 (tradename) densitometer was used provided with a visual filter. The measured optical density after subtracting the optical density of the support was 1.03.

INVENTION EXAMPLES 2 to 4

Analogously to the preparation of invention material B1 of Invention Example 1 other invention-materials were prepared. The following Table contains a description of the fillers used instead of the anatase type $TiO_2$ of Example 1.

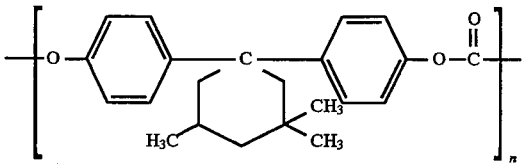

After coating the layers with fillers numbered 1 to 3 onto the above mentioned transparent support and drying and before thermal printing, the "transmission" optical density of the opaque layers obtained with said fillers was measured with a Macbeth TD 504 (tradename) densitometer provided with a visual filter. The measured optical density of the thus coated materials after subtracting the optical density of the support was respectively 1.1, 0.26 and 0.47.

INVENTION EXAMPLE 5 and COMPARATIVE EXAMPLE 2

A transparent subbed polyethylene terephthalate support having a thickness of 175 μm was doctor blade-coated from a coating composition containing 2-butanone as a solvent and the following ingredients so as to obtain thereon, after drying at 70° C., a heat-sensitive imaging layer containing:

| | |
|---|---|
| silver behenate | 4.74 g/m$^2$ |
| polyvinyl butyral (BUTVAR B79-tradename) | 18.92 g/m$^2$ |
| 3,4-dihydro-2,4-dioxo-1,3,2H-benzoxazine | 0.346 g/m$^2$ |
| 3,4-dihydroxybenzoic acid butyl ester | 1.118 g/m$^2$ |

-continued

| | |
|---|---|
| tetrachlorophthalic anhydride | 0.151 g/m$^2$ |
| pimelic acid | 0.495 g/m$^2$ |

This heat-sensitive imaging layer was then coated with opaque protective layers:

from an aqueous dispersion in the case of INVENTION EXAMPLE 5 to produce a layer containing:

| | |
|---|---|
| 0.1–0.2 μm titanium dioxide (anatase type) | 10 g/m$^2$ |
| tetramethylorthosilicate | 2.4 g/m$^2$ |
| polyvinylalcohol [Polyviol WX48 20 (trademark) from Wacker Chemie] | 2.8 g/m$^2$ |
| copolyether-siloxane [Tegoglide ZG400 (trademark) from TEGO-chemie] | 0.1 g/m$^2$ |
| tenside [Ultravon W (trademark) from Ciba-Geigy] | 0.1 g/m$^2$ |

which after drying at 40° C. and crosslinking for 2 days at 57° C. produced a good homogeneous layer with a reflection density measured with a MacBeth TR924 (tradename) densitometer through the support of 1.90, after subtracting the optical density of the support.

from an organic solvent (2-butanone) dispersion in the case of COMPARATIVE EXAMPLE 2 to produce a layer containing:

| | |
|---|---|
| 0.1–0.2 μm titanium dioxide (anatase type) | 10 g/m$^2$ |
| polycarbonate PC (as described below) | 5 g/m$^2$ |

which after drying at room temperature produced a poor quality layer with cloudiness and visual non-uniform distribution of the opacifying pigment particles due to a pattern in the protective layer induced by the drying process; and a reflection density measured with a MacBeth TR924 (tradename) densitometer through the support of 1.89, after subtracting the optical density of the support.

Polycarbonate PC has the following structure:

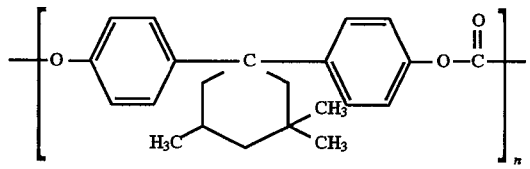

and has a relative viscosity of 1.3 in a 0.5% solution in dichloromethane. The viscosity ratio is by definition the quotient of the viscosity of the polymer solution and of the pure solvent measured at the same temperature, here 20° C.

thermographic printing 10 cm×10 cm sheets of the heat-sensitive recording materials of INVENTION EXAMPLE 5 and COMPARATIVE EXAMPLE 2 were processed in a thermal head printer MITSUBISHI CP100 (tradename) having the printhead in direct contact with the opaque anti-stick protective layers of said heat-sensitive recording materials, a 64-step grey wedge being printed in each case.

The opaque anti-stick protective layer of sheets of the heat-sensitive recording material of INVENTION EXAMPLE 5 was undamaged during the printing process, whereas that of sheets of the "non-invention" heat-sensitive recording material of COMPARATIVE EXAMPLE 2 was clearly damaged at image areas in which there is a transition from high to low optical densities.

The optical density before printing and the maximum density after printing of the heat-sensitive recording materials of INVENTION EXAMPLE 5 and COMPARATIVE EXAMPLE 2 were determined in transmission with a MacBeth TR924 (tradename) densitometer with the following results:

| | medium from which protective layer was coated | transmission density before printing | transmission density max. after printing |
|---|---|---|---|
| INVENTION EXAMPLE 5 | water | 0.57 | 3.99 |
| COMPARATIVE EXAMPLE 2 | 2-butanone | 0.75 | 3.73 |

The above results show that, notwithstanding that heat-sensitive recording materials with opaque protective layers coated from both water and organic solvents (e.g. 2-butanone) exhibit high maximum print-densities, heat-sensitive recording materials with opaque protective layers coated from water are much less susceptible to surface damage during the printing process.

We claim:

1. A heat-sensitive recording material being suited for use in direct thermal imaging and comprising in the order given:

(i) a transparent polymeric support, (ii) a heat-sensitive imaging layer, and (iii) a protective layer wherein said protective layer is an opaque layer containing uniformly distributed in an organic hydrophilic polymeric binder at least one opacifying pigment in the form of particulate material some of which protrudes from the surface of said binder and has anti-stick properties with regard to a thermal print head, wherein the opacity of layer (iii) corresponds with an absorption and/or scattering of at least 80% of the light of the visible wavelength range.

2. Recording material according to claim 1, wherein an intermediate layer acting as an adhesion-promoting layer is present between layers (ii) and (iii).

3. Recording material according to claim 1, wherein layer (iii) has been provided with an outermost anti-sticking layer.

4. Recording material according to claim 1, wherein the hydrophilic polymeric binder of said opaque layer is a proteinaceous binding agent.

5. Recording material according to claim 4, wherein said hydrophilic polymeric binder is gelatin.

6. Recording material according to claim 1, wherein said opacifying agent has anti-stick properties with regard to thermal printheads and is selected from inorganic or organic pigments.

7. Recording material according to claim 6, wherein the weight ratio of said opaque pigment particles to said binder in said opaque layer (iii) is in the range of 1/2 to 25/1.

8. Recording material according to claim 6, wherein said opaque pigment particles have an average grain size in the range of 0.25 to 20 μm.

9. Recording material according to claim 8, wherein said pigments are inorganic particles selected from the group consisting of silica, titanium dioxide, China clay, mica, calcium silicate, aluminum silicate, talc, and aluminum magnesium silicate.

10. Recording material according to claim 1, wherein the opaque layer (iii) has a thickness in the range of 5 to 30 μm.

11. Recording material according to claim 1, wherein said opaque layer (iii) is densely populated with protruding opacifying pigment particles giving said layer a roughness depth in the range of 5 to 10 μm.

12. Recording material according to claim 1, wherein said heat-sensitive imaging layer (ii) contains in binder a substantially light-insensitive organic heavy metal salt in thermal working relationship with an organic reducing agent.

13. Recording material according claim 12, wherein said heat-sensitive imaging layer (ii) contains in binder a substantially light-insensitive organic silver salt in thermal working relationship with an organic reducing agent.

14. Recording material according to claim 13, wherein said heat-sensitive imaging layer (ii) contains in binder a substantially light-insensitive fatty acid silver salt in thermal working relationship with an organic reducing agent.

15. Recording material according to claim 14, wherein said heat-sensitive imaging layer (ii) contains in binder substantially light-insensitive silver behenate in thermal working relationship with an organic reducing agent.

16. A process for the production of said heat-sensitive recording material being suited for use in direct thermal imaging comprising the steps of: (I) coating a heat-sensitive imaging layer (ii) onto a transparent polymeric support (i); and (II) coating a protective layer (iii) onto said heat-sensitive imaging layer (ii), characterized in that said layer (iii) is an opaque layer containing uniformly distributed in an organic hydrophilic polymeric binder at least one opacifying pigment in the form of particulate material some of which protrudes from the surface of said binder, has anti-stick properties with regard to a thermal print head, an opacity corresponding to an absorption and/or scattering of at least 80% of the light of the visible wavelength range and is coated from an aqueous dispersion of said opacifying pigment particles or precursors thereof.

17. A recording process wherein said heat-sensitive recording material according to claim 1, is exposed to a heat pattern in direct thermal imaging, by which is meant that during the application of said heat pattern a visible image is formed in said recording material without the aid of (a) substance(s) that are thermally pattern-wise transferred thereon and/or therein.

18. Recording process according to claim 17, wherein said heat-sensitive recording material is image-wise heated by means of a thermal head containing a plurality of image-wise electrically energized heating elements.

* * * * *